US008549819B1

(12) United States Patent
Bison

(10) Patent No.: US 8,549,819 B1
(45) Date of Patent: Oct. 8, 2013

(54) PALLET ROPING AND WRAPPING APPARATUS AND METHOD

(76) Inventor: Darrel Bison, Phoenix, AZ (US)

( * ) Notice: Subject to any disclaimer, the term of this patent is extended or adjusted under 35 U.S.C. 154(b) by 612 days.

(21) Appl. No.: 12/726,273

(22) Filed: Mar. 17, 2010

Related U.S. Application Data

(63) Continuation-in-part of application No. 12/551,167, filed on Aug. 31, 2009, now Pat. No. 8,046,975, which is a continuation of application No. 11/668,954, filed on Jan. 30, 2007, now Pat. No. 7,581,368.

(60) Provisional application No. 60/829,339, filed on Oct. 13, 2006, provisional application No. 60/829,085, filed on Oct. 11, 2006.

(51) Int. Cl.
*B65B 11/02* (2006.01)
*B65B 11/04* (2006.01)
*B65B 11/58* (2006.01)

(52) U.S. Cl.
USPC ..... 53/399; 53/441; 53/449; 53/176; 53/556; 53/587; 53/588

(58) Field of Classification Search
CPC .... B65B 11/04; B65B 11/006; B65B 11/025; B65B 11/045; B65B 11/585; B65B 2011/002; B65B 2210/20
USPC ..... 53/399, 441, 449, 465, 170, 176, 53/556, 587, 588, 589, 210, 211, 218
IPC ..... B65B 11/04, 11/006, 11/025, 11/045, B65B 11/585, 2011/02, 2210/20, 11/58, 11/02
See application file for complete search history.

(56) References Cited

U.S. PATENT DOCUMENTS

| | | | | |
|---|---|---|---|---|
| 1,351,809 | A * | 9/1920 | Sutherland | 53/211 |
| 2,026,282 | A | 12/1935 | Leguillon | |
| 2,823,530 | A * | 2/1958 | Rikard | 242/118.41 |
| 3,793,798 | A * | 2/1974 | Lancaster, III et al. | 53/465 |
| 3,896,604 | A | 7/1975 | Marantz | |
| 4,102,513 | A | 7/1978 | Guard | |

(Continued)

FOREIGN PATENT DOCUMENTS

| | | | | |
|---|---|---|---|---|
| DE | 3933952 | A1 * | 5/1990 | 53/211 |
| DE | 19505240 | C1 * | 3/1996 | B65B 11/02 |

(Continued)

OTHER PUBLICATIONS

USPTO translation of JP 2-45309 A, Aug. 13, 2013, 7 pages.*

(Continued)

*Primary Examiner* — Stephen F Gerrity
(74) *Attorney, Agent, or Firm* — Booth Udall Fuller, PLC

(57) ABSTRACT

Pallet roping and wrapping machines having a plurality of spools of stretch film supported on a single spool and guides that form ropes of stretch film without cutting. Specific implementations of guides include guides formed of rings and rollers. Positions of guides may be adjustable. A first roll of stretch film may be used with a second roll of stretch film, where the second roll of stretch film is narrowed into ropes and combined with a web from the first roll of stretch film. The combination of film from the first roll of stretch film and narrowed film from the second roll of stretch film may be pre-stretched prior to be applied to a load.

17 Claims, 10 Drawing Sheets

(56) References Cited

U.S. PATENT DOCUMENTS

| | | | | | |
|---|---|---|---|---|---|
| 4,166,589 | A | | 9/1979 | Hoover et al. | |
| 4,235,062 | A | | 11/1980 | Lancaster et al. | |
| 4,255,918 | A | | 3/1981 | Lancaster et al. | |
| 4,353,515 | A | | 10/1982 | Weaver et al. | |
| 4,468,922 | A | | 9/1984 | McCrady et al. | |
| 4,530,473 | A | * | 7/1985 | Parry | 242/588.2 |
| 4,619,102 | A | | 10/1986 | Geisinger | |
| 4,671,043 | A | * | 6/1987 | Forni et al. | 53/399 |
| 4,739,945 | A | * | 4/1988 | Yokoe | 242/118.41 |
| 4,807,427 | A | | 2/1989 | Casteel et al. | |
| 4,845,920 | A | | 7/1989 | Lancaster | |
| 4,905,448 | A | * | 3/1990 | Plitt | 53/399 |
| 4,905,451 | A | * | 3/1990 | Jaconelli et al. | 53/211 |
| 4,961,306 | A | | 10/1990 | Sawhney et al. | |
| 5,031,771 | A | | 7/1991 | Lancaster | |
| 5,079,898 | A | | 1/1992 | Springs et al. | |
| 5,107,657 | A | | 4/1992 | Diehl et al. | |
| 5,125,209 | A | | 6/1992 | Thimon et al. | |
| 5,168,685 | A | | 12/1992 | Suzuki | |
| 5,195,297 | A | | 3/1993 | Lancaster et al. | |
| 5,203,939 | A | | 4/1993 | Sperling et al. | |
| 5,211,353 | A | * | 5/1993 | Lewin et al. | 242/118.41 |
| 5,307,609 | A | * | 5/1994 | Kurata et al. | 53/556 |
| 5,315,808 | A | | 5/1994 | MacIvor et al. | |
| 5,385,001 | A | | 1/1995 | Ramer | |
| 5,409,177 | A | * | 4/1995 | Parry et al. | 242/588.2 |
| 5,447,009 | A | | 9/1995 | Oleksy et al. | |
| 5,535,962 | A | * | 7/1996 | Bargowski | 242/594.3 |
| 5,965,262 | A | | 10/1999 | Whisler et al. | |
| 6,164,047 | A | | 12/2000 | Rossi | |
| 6,393,808 | B1 | * | 5/2002 | Kallner et al. | 53/556 |
| 6,745,544 | B2 | | 6/2004 | Matsumoto et al. | |
| 6,892,515 | B2 | | 5/2005 | Cere' | |
| 6,971,220 | B1 | | 12/2005 | Rampp | |
| 7,269,935 | B2 | * | 9/2007 | Jafari | 53/588 |
| 7,621,107 | B2 | * | 11/2009 | Vanderheiden et al. | 53/441 |
| 7,908,831 | B1 | * | 3/2011 | Dugan | 53/587 |
| 8,053,056 | B2 | * | 11/2011 | Heikaus et al. | 428/138 |
| 8,276,349 | B2 | * | 10/2012 | Van Amstel et al. | 53/441 |
| 2008/0092489 | A1 | | 4/2008 | Smith | |
| 2008/0209859 | A1 | | 9/2008 | Vanderheiden et al. | |
| 2009/0277136 | A1 | * | 11/2009 | Van Amstel et al. | 53/441 |
| 2011/0088359 | A1 | * | 4/2011 | Brocard | 53/461 |

FOREIGN PATENT DOCUMENTS

| | | | | | |
|---|---|---|---|---|---|
| EP | 178145 | A1 | * | 4/1986 | 53/556 |
| EP | 1332968 | A1 | * | 8/2003 | B65B 11/02 |
| EP | 1803345 | A1 | * | 7/2007 | A01F 15/07 |
| GB | 2241484 | A | * | 9/1991 | B65B 11/04 |
| JP | 02045309 | A | * | 2/1990 | 100/218 |
| JP | 04215903 | A | * | 8/1992 | B65B 11/04 |
| JP | 04327108 | A | * | 11/1992 | B65B 11/04 |
| JP | 10129609 | A | * | 5/1998 | B65B 11/04 |
| JP | 2000302102 | A | * | 10/2000 | B65B 11/04 |
| JP | 2002166905 | A | * | 6/2002 | B65B 11/04 |
| JP | 2002211502 | A | * | 7/2002 | B65B 11/04 |
| JP | 2002225806 | A | * | 8/2002 | B65B 11/08 |
| JP | 2002225807 | A | * | 8/2002 | B65B 11/08 |
| WO | WO 9012737 | A1 | * | 11/1990 | 53/211 |
| WO | WO 2009155713 | A2 | * | 12/2009 | B65B 11/02 |

OTHER PUBLICATIONS

JPO machine translation of JP 10-129609 A, Aug. 14, 2013, 4 pages.*
JPO machine translation of JP 2002-225806 A, Aug. 14, 2013, 15 pages.*

* cited by examiner

PALLET ROPING AND WRAPPING APPARATUS AND METHOD

CROSS REFERENCE TO RELATED APPLICATIONS

This application is a continuation-in-part of U.S. Patent application entitled PALLET ROPING AND WRAPPING APPARATUS, Ser. No. 12/551,167, filed Aug. 31, 2009, now U.S. Pat. No. 8,046,975, which is a continuation of U.S. Utility Patent Application entitled PALLET ROPING AND WRAPPING APPARATUS Ser. No. 11/668,954 which was filed on Jan. 30, 2007, and is now U.S. Pat. No. 7,581,368, which claims the benefit of the filing date of U.S. Provisional Patent Application No. 60/829,339, entitled HAND ROPER, which was filed on Oct. 13, 2006, and of the filing date of U.S. Provisional Patent Application No. 60/829,085, entitled RAPIDROPER, which was filed on Oct. 11, 2006, the contents of each of which are each hereby incorporated herein by reference.

BACKGROUND

1. Technical Field

Aspects of this document relate generally to securing and protecting palletized loads.

2. Background Art

Goods to be transported in containers on, for example, ships, trucks, trains or the like frequently are packed on pallets. Such palletized goods or material, further, may be wrapped in stretch film in order to protect the material from damage caused by, for example, shifting on a pallet or being bumped by goods on adjacent pallets.

Material such as furniture or boxed goods may be completely wrapped in contiguously overlapping stretch film, effectively sealing wrapped material from contact with air or from contact with other material, which may be, for example, on other pallets. However, other types of material, such as, for example, fresh fruits and vegetables, require that air be allowed to circulate among the palletized material in order to prevent buildup of condensation or to aid in cooling or warming the material. One known method for packing these kinds of goods includes wrapping the palletized material in netting, or with a rope rather than in stretch film.

SUMMARY

In one aspect, particular implementations of pallet wrapping and roping machines comprise an apparatus for securing a palletized load, the apparatus comprising a spool support member. In another aspect, particular implementations may comprise a plurality of rolls of stretch film on a single spool, the spool being supported by the spool support member. In yet another aspect, particular implementations may comprise a guide support member oriented substantially parallel to the spool and sharing mechanical support with the spool support member. In still yet another aspect, particular implementations may comprise a plurality of guides coupled to the guide support member, each guide having stretch film from a roll of the plurality of rolls passed through the guide, thereby forming a plurality of ropes of stretch film, each stretch film roll remaining uncut by the apparatus. For other particular implementations, the plurality of rolls comprises two rolls. For still other particular implementations, the plurality of rolls of stretch film on a single spool comprises rolls positioned essentially contiguously on the spool.

In another aspect, particular implementations of pallet wrapping and roping machines comprise an apparatus for securing a palletized load, the apparatus comprising a first roll of stretch film supported by a first spool support member, at least one second roll of stretch film supported by a second spool support member, a plurality of guides positioned adjacent to the second spool support member, where each set of guides has a guide width less than a width of the at least one second roll, and where the second roll of stretch film positioned to pass through the guide. In particular implementations, a portion of a first path of the stretch film from the first roll of stretch film to a load to be secured and a portion of a second path of the stretch film from the at least one second roll of stretch film to the load to be secured overlap after the film from the second roll of stretch film passes through the plurality of guides such that the stretch film from the at least one second roll of stretch film is applied to the load simultaneous with the stretch film from the first roll of stretch film. Other particular implementations may include one or more of the following features. The at least one second roll may comprise at least two separate rolls of stretch film on a common spool core, the spool core being positionally coupled to each of the plurality of rolls such that the rolls unroll at substantially the same rate, the spool core being supported by the second spool support member. The apparatus may further comprise a pre-stretch carriage along the first path and the second path between the first and second rolls of stretch film and the load; wherein the first path and the second path overlap through the pre-stretch carriage. The pre-stretch carriage may be configured to simultaneously stretch the overlapping stretch film from the first roll of stretch film and stretch film from the at least one at least one second roll of stretch film prior to the stretch films being simultaneously applied to the load. The stretch film from the at least one second roll of stretch film may pass through at least two sets of guides to form at least two separate bands of stretch film from the at least one second roll of stretch film. The pre-stretch carriage may be configured to simultaneously stretch the overlapping stretch film from the first roll of stretch film and the at least two separate bands of stretch film from the at least one at least one second roll of stretch film prior to the stretch films being simultaneously applied to the load.

In still another aspect, a method of securing a palletized load comprises dispensing a first stretch film from a first roll of stretch film supported on a first support member, dispensing at least a second stretch film from at least a second roll of stretch film supported on a second support member and narrowing a band width of the at least a second stretch film member with at least one guide, overlapping the first stretch film and the narrowed second stretch film, and simultaneously applying the overlapped first stretch film and second stretch film to a load to be secured after they have been overlapped. Particular implementations may comprise one or more of the following features. Dispensing the at least a second stretch film from the at least a second roll of stretch film may comprise dispensing at least two bands of stretch film. Overlapping the first stretch film and the second stretch film may comprise overlapping with the at least two bands of stretch film spaced from each other. Simultaneously pre-stretching the dispensed first stretch film and second stretch film while overlapped may occur prior to applying the first and second stretch films to the load. Simultaneously pre-stretching the first and second stretch films may comprise simultaneously pre-stretching the first and second stretch films in a pre-stretch carriage. Simultaneously pre-stretching the first and second stretch films may further comprise simultaneously pre-stretching the dispensed first stretch film and at least two bands of the second stretched film while overlapped prior to applying the films to the load. Dispensing the at least a second stretch film from the at least a second roll of stretch film may further comprise dispensing the at least a second stretch film from at least two separate rolls of stretch film supported on a common spool core. Simultaneously applying the overlapped first and second stretch films may comprise circumnavigating the palletized load with the overlapped first and second stretch films resulting in multiple layers of overlapped first and second stretch films overlapped upon each other. Applying the overlapped first and second stretch films may result in the first stretch film being closer to the load than the second stretch film. Applying the overlapped first and second stretch films may result in the second stretch film being closer to the load than the first stretch film. Perforating the first and second stretch films prior to applying the first and second films.

In still yet another aspect, an apparatus for securing a palletized load comprises a first roll of stretch film supported by a first spool support member, a plurality of separate rolls of stretch film on a common spool core, the spool core being positionally coupled to each of the plurality of rolls such that the rolls unroll at substantially the same rate, the spool core being supported by a second spool support member, wherein the first roll, plurality of separate rolls and a pre-stretch carriage are mutually positioned such that the pre-stretch carriage simultaneously receives first stretch film from the first roll and second stretch film from the plurality of separate rolls in an overlapped manner and simultaneously pre-stretches the first and second stretch prior to simultaneously applying the overlapped first and second stretch films to a load. The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Various aspects of implementations of pallet wrapping and roping machines will hereinafter be described in conjunction with the appended drawings, where like designations denote like elements, and.

DESCRIPTION

This disclosure, its aspects and implementations, are not limited to the specific devices and methods disclosed herein. Many additional elements, components, and procedures known in the art consistent with the intended use of the apparatus and methods described will become apparent for use with various implementations of pallet-wrapping apparatus and techniques from this disclosure. Accordingly, for example, although a particular apparatus may be disclosed, such apparatus may comprise any shape, size, style, type, model, version, material, and/or the like as is known in the art for such apparatus, consistent with the intended operation of the devices described herein.

Figure 1:
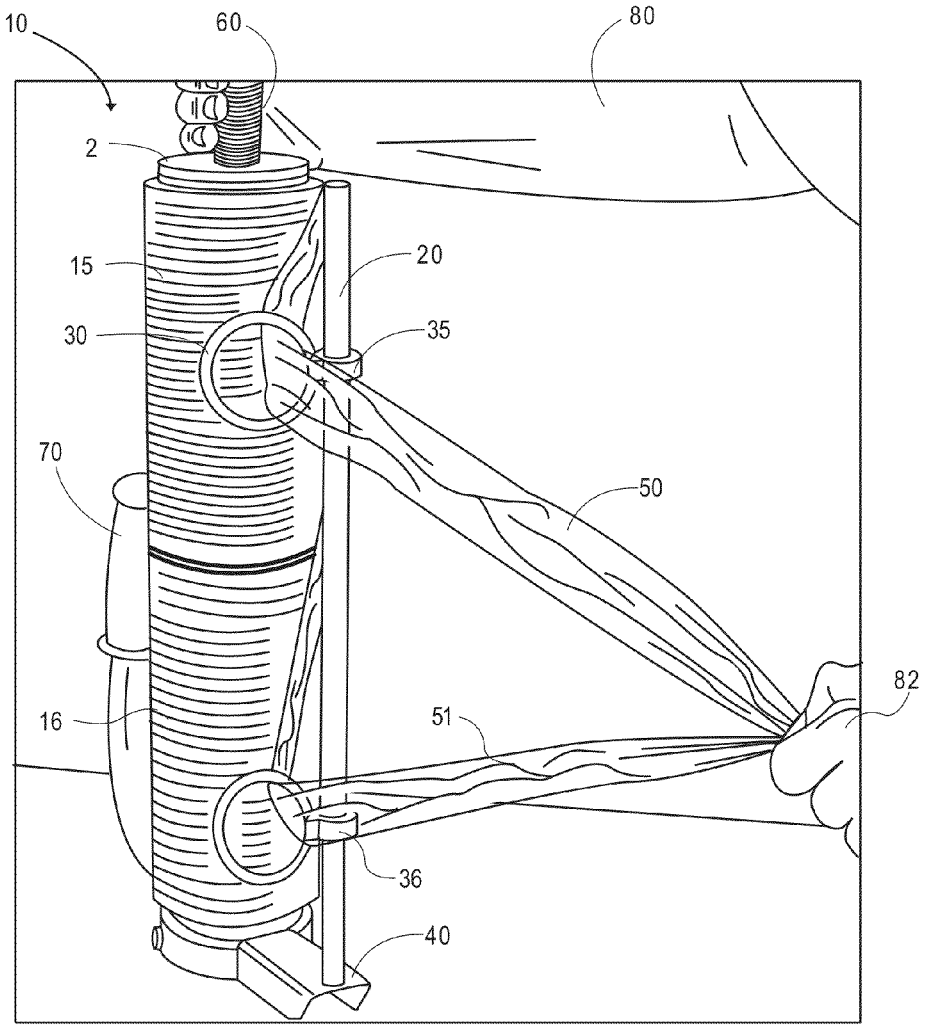
FIG. 1 is a pictorial diagram of a particular implementation of an apparatus for wrapping palletized loads.

A particular implementation of a pallet roping and wrapping apparatus 10, which may be employed for securing a palletized load, is shown in FIG. 1. The apparatus 10 comprises a first roll 15 and a second roll 16 of stretch film and a single spool 2 configured to support the first and second rolls 15 and 16 of stretch film. The first and second rolls 15 and 16 may be positioned essentially contiguously on the spool 2. The apparatus 10 further may comprise a baseplate 40 and a spool support member (which may be a rod, not shown) adapted to support the spool 2, the spool support member having an end affixed to and supported by the baseplate 40. The spool 2 may have an axis that typically coincides with a center axis shared by the first and second rolls 15 and 16 of stretch film. The illustrated implementation still further comprises a pair of guides, first guide 30 and second guide 31, and a guide support member 20, which may comprise, for example, a rod. The guide support member 20 may have an end coupled to and supported by the baseplate 40. That is, the spool support member and the guide support member 20 may share mechanical support provided by the baseplate 40. The guide support member 20 may have an axis oriented to be substantially parallel to the axis of the spool 2 in normal operation. In the illustrated implementation of FIG. 1, the first and second guides 30 and 31 are formed as rings. First guide 30 is secured to the guide support member 20 by a first collar 35 that may be adjustably positioned on the guide support member 20 at a location nominally opposite a midpoint of the first roll 15. Likewise, second guide 31, which also may have an adjustable position according to a location of a second collar 36, may be located nominally opposite a midpoint of the second roll 16. The illustrated positions of first and second guides 30 and 31 are only examples, as positions of the first and second guides 30 and 31 may be adjusted in either a ganged fashion or independently according to needs or preferences of a user of the apparatus 10.

Stretch film from first and second rolls 15 and 16 may be threaded or otherwise passed through first and second guides 30 and 31 to form a first rope 50 and a second rope 51 of stretch film. It should be noted that in the industry a "rope" is also sometimes called a "band." It should also be noted that there is no need to cut or otherwise modify, distort, or weaken the stretch film coming from the roll. Any such cutting, modifying, or distorting is obviated by the use of separate first and second rolls 15 and 16 of stretch film. Indeed, known devices that require cutting of stretch film or that employ cutting or distorting of stretch film in their operation may cause inconvenience and expense to users of the known devices as a result of consequential breaking and/or tearing of the stretch film.

It should be understood that the present disclosure contemplates using a plurality of rolls of stretch film and that first and second rolls 15 and 16 in the particular implementation illustrated in FIG. 1 are not intended to be limiting. Likewise, particular implementations of apparatus for securing palletized loads may comprise a plurality of guides (e.g., first and second guides 30 and 31, or more) being adjustably secured to a guide support member 20 by a plurality of collars (e.g., first and second collars 35 and 36). An implementation comprising such a plurality of rolls and guides may be employed to form a plurality of ropes (e.g., first and second ropes 50 and 51, or more) of stretch film with which to wrap or otherwise secure a palletized load.

Adjustment of positions of the guides (e.g., first and second guides 30 and 31) may be accomplished in one exemplary implementation using set screws (not shown) employed in the collars in a conventional manner. Adjustable clamps may replace the collars in other implementations without departing from any intention of the present disclosure.

Figure 2:
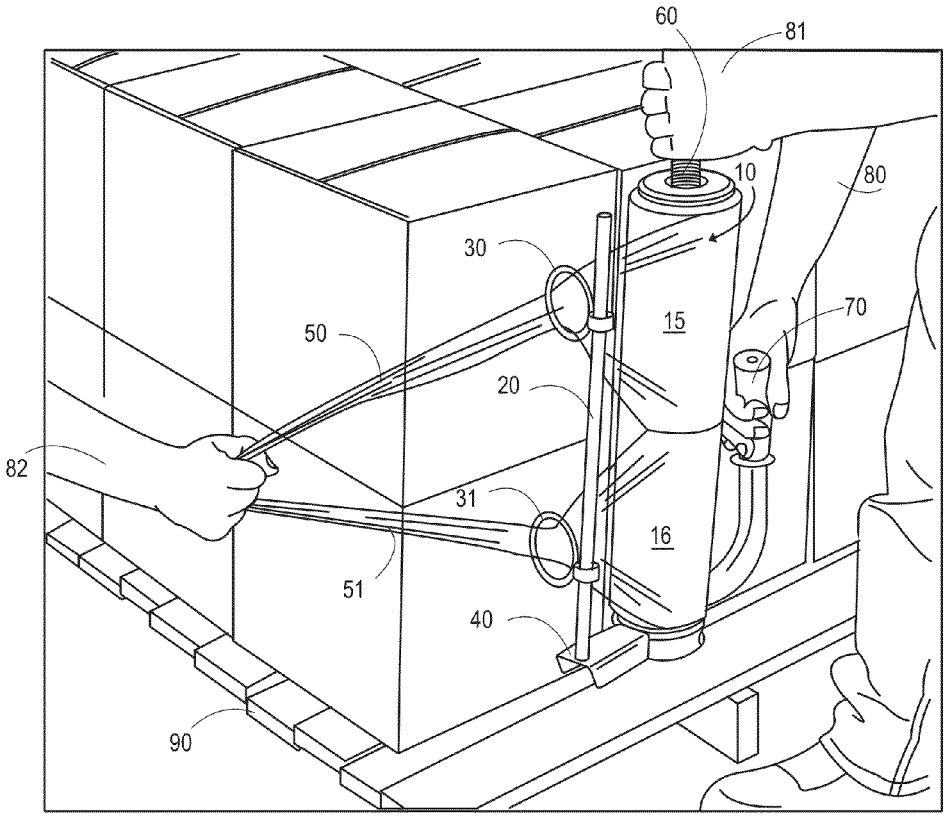
FIG. 2 is a pictorial diagram of the particular implementation of FIG. 1 illustrating hand-held use of the apparatus.

An axial handle 60 may be coupled to an end of the spool support member, the axial handle having an axis nominally aligned with the center axis shared by the spool support member and the first and second rolls 15 and 16 of stretch film. A side handle 70, further, may be affixed to the baseplate 40. A first user supporting the apparatus would hold both the axial handle 60 and the side handle 70. Arm 80 and hand 81 (See FIGS. 1 and 2) are from the user supporting the apparatus. A second user may draw the first and second ropes 50 and 51 using hand 82. The side handle 70 and the axial handle 60 may be employed by a user to support the particular apparatus 10 as illustrated in FIG. 2. Alternative or differently configured handles may be used. As is further illustrated in FIG. 2, the side handle 70 and the axial handle 60 may be employed by a user move the apparatus 10 around a palletized load in order to extend first and second ropes 50 and 51, thereby wrapping and/or securing the palletized load.

For example, a first user may support the apparatus 10 by using a hand on a first arm 80 to grasp the side handle 70 and a second hand 81 to grasp the axial handle 60. First and second ropes 50 and 51 may be grasped by a hand 82 of a second user to hold ends of the first and second ropes 50 and 51 while the first user circumnavigates (e.g., walks around) a palletized load situated on a nominally stationary pallet 90, thereby wrapping and securing the palletized load. In another particular implementation described more particularly with reference to FIG. 6, a pallet wrapping device remains stationary while a palletized load is rotated in order to accomplish wrapping of ropes of stretch film around the load.

Figure 3A:
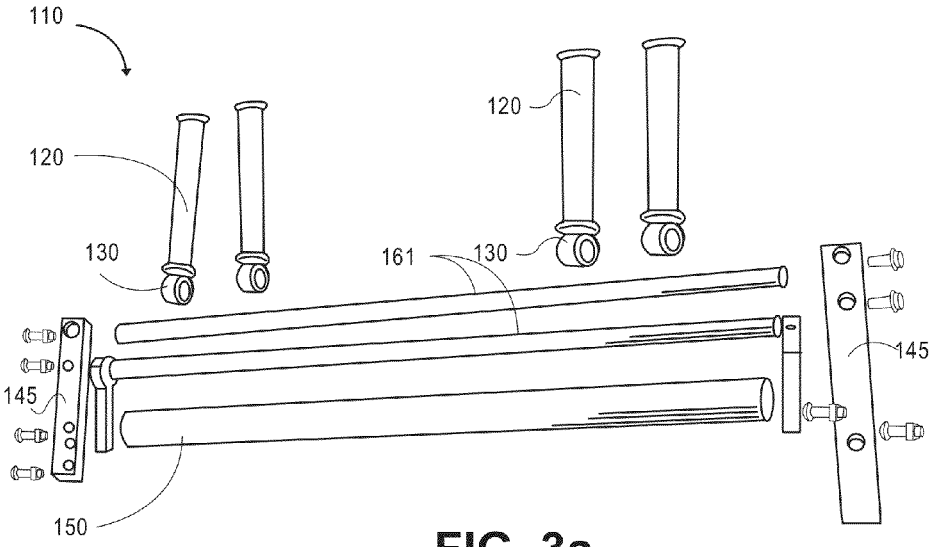
FIG. 3*a* is a disassembled view of a subassembly of another particular implementation of a palletized load-wrapping apparatus.
Figure 3B:
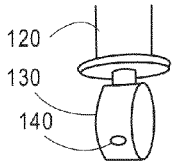
FIG. 3*b* is a close-up view of a portion of FIG. 3*a;*

FIG. 3*a* is a disassembled view of a subassembly 110 of a particular implementation of a stretch wrap machine 170 (FIG. 5), which may function as a palletized load wrapping apparatus. Elements of this subassembly 110 of the stretch wrap machine 170 include a plurality of rollers 120 (four are shown in FIG. 3*a*), which may be used to form guides that may perform a function similar to first and second guides 30 and 31 introduced in FIGS. 1 and 2. The rollers 120 may have affixed thereto collars 130 that may slidably and adjustably fit over a rod 161 having first and second ends, the rod 161 being adapted to function as a supporting member for the plurality of rollers 120. The collars 130 may include set screws 140 suitable for facilitating adjustment of positions of the plurality of rollers 120 along the rod 161. The illustrated subassembly 110 further comprises a pair of brackets 145 adapted to provide mechanical support for the first and second ends of the rod 161. FIG. 3*b* is a close-up view of the collars 130, rollers 120 and set screws 140.

Figure 4:
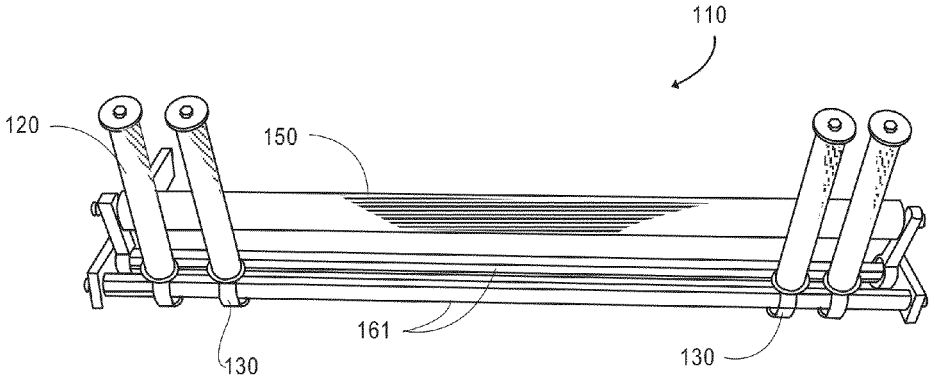
FIG. 4 is a view of the subassembly of FIG. 3*a* when assembled.

FIG. 4 is a partially-assembled subassembly 110 of FIG. 3*a* illustrating the plurality of rollers 120 affixed to the supporting member or rod 161 by collars 130. The partially-assembled subassembly 110 further includes a wrap machine roller 150 having ends mechanically secured by the pair of brackets 145 that also secure ends of the rod 161 in a manner well-understood by one skilled in the art.

Figure 5:
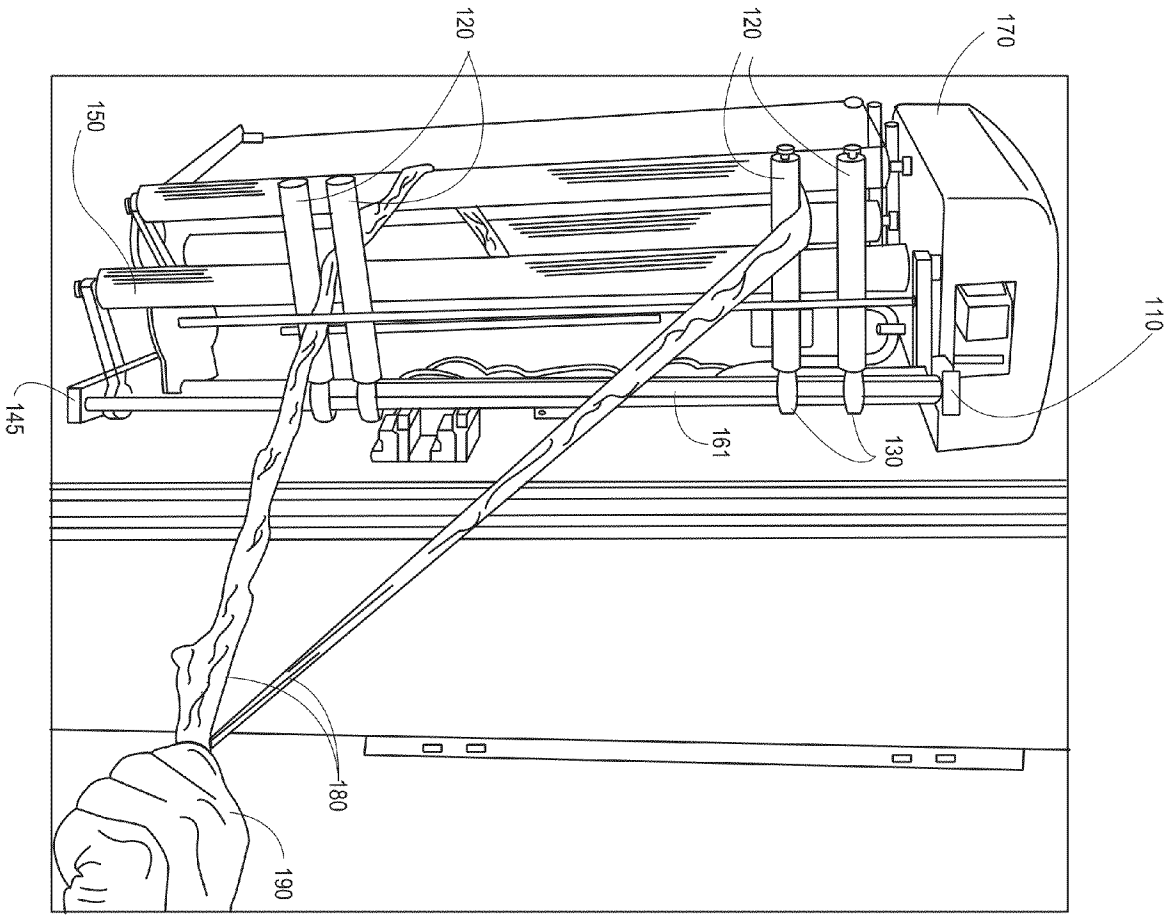
FIG. 5 is a pictorial diagram of a stretch wrap machine that includes a particular implementation of a rope-forming apparatus.

FIG. 5 is a pictorial diagram of a stretch wrap machine 170 that includes the subassembly 110 described above with reference to FIGS. 3 and 4. The stretch wrap machine 170, which may be employed as a palletized load-wrapping apparatus, may be configured for applications suited to wrapping palletized loads that arrive at the stretch wrap machine 170 on, for example, a conveyer belt, front loader or other transport medium. Typical implementations of the stretch wrap machine 170 include a rotating platform (not shown) on which may be placed a palletized load ready for wrapping. A driving mechanism (not shown) may cause the platform to rotate while a remainder of the stretch wrap machine 170 remains essentially stationary relative to the palletized load intended to be secured by the stretch wrap machine 170. It is understood that "stationary" in the present context means that the palletized load may be free to rotate, but that the load does not undergo translational motion once it arrives at the stretch wrap machine 170 until after any wrapping procedure is completed.

The implementation of the stretch wrap machine 170 illustrated in FIG. 5 comprises the subassembly 110 described in greater detail with reference to FIGS. 3 and 4. The illustrated implementation further comprises elements not shown in FIG. 5, but that may be similar to those illustrated in another implementation 270 of a stretch wrap machine shown in FIG. 6. These elements may include a spool 202, and a plurality of rolls of stretch film, e.g., first roll 215 and second roll 216 disposed essentially adjacently on the spool 202.

Returning to FIG. 5, stretch film may be passed between pairs of rollers 120, which may function as guides, thereby forming ropes 180 of stretch film. Although two pairs of rollers 120 and two ropes 180 are illustrated in FIG. 5, the description applies as well to a plurality of pairs of rollers, which may facilitate forming of a corresponding plurality of ropes of stretch film. As the palletized load rotates and a starting point for the plurality of ropes of stretch film is established on the palletized load, the palletized load may become wrapped with the plurality of ropes of stretch film.

Figure 6:
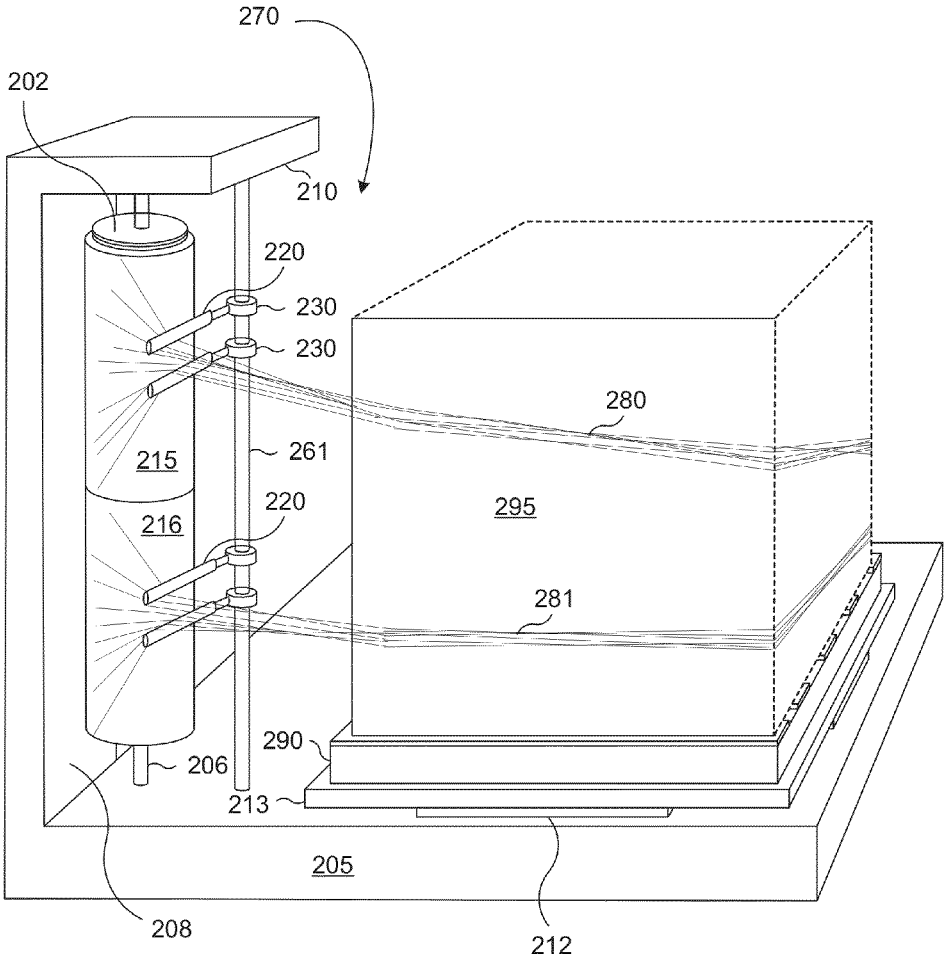
FIG. 6 is a pictorial diagram of a stretch wrap machine.

FIG. 6 is a pictorial diagram of a stationary stretch wrap machine 270 that may include elements described with reference to FIG. 5. The illustrated implementation comprises a spool 202 mounted on a spool support member 206, which is coupled at a first end on a platform 205 and supported on a second end by a bracket 210 that is essentially rigidly connected with the platform 205 by a connecting member 208. The spool 202 has disposed (e.g., wound) thereon first and second rolls 215 and 216 of stretch film, axes of the first and second rolls 215 and 216 essentially coinciding with an axis of the spool 202. Typically, first and second rolls 215 and 216 are disposed next to each other on the spool. The first and second rolls 215 and 216 may be disposed directly on the spool or disposed on separate spools that are then disposed on a common spool or roller (e.g. a common core with two spools around it and coupled to it) with the purpose that the first and second rolls necessarily unroll at substantially the same rate. If the first and second rolls 215 and 216 do not spin at substantially the same rate, as is necessitated by being on the same spool 202 or being otherwise equivalently forced to spin at substantially the same rate, the operation is less effective.

A guide support member 261, which is supported at a first end by the platform 205 and at a second end by the bracket 210, may be disposed nominally parallel to and at a convenient distance from the spool 202. That is, guide support member 261 may have an axis that is parallel to the axis of the spool 202. A plurality of rollers 220, which may be arranged in pairs to form guides, two of which are illustrated, for example, in FIG. 6, are adjustably connected with the guide support member 261 by a plurality of collars 230. The collars 230 may be configured so that positions of the plurality of rollers 220 may be adjusted.

Stretch film from the first and second rolls 215 and 216 pass through a pair of guides (formed by pairs of rollers 220 in the implementation shown in FIG. 6), forming first and second ropes 280 and 281 of stretch film. This disclosure, further, contemplates using two or more rolls, i.e., a plurality of rolls of stretch film in order to form a plurality of ropes of stretch film, by passing the stretch film through a plurality of guides although only two rolls, guides and ropes are illustrated in FIG. 6.

The platform 205 may have disposed thereon a support 212 that supports a rotatable platform 213 on which may be placed a pallet 290 of palletized goods 295 shown in dotted outline in FIG. 6 to reflect an arbitrary nature of an arrangement of the palletized goods 295. In operation, the pallet 290 and the palletized goods 295 may arrive at the stretch wrap machine 270 and may be placed onto the rotatable platform 213. First and second ropes 280 and 281 of stretch film may be formed as described herein and attached at initial ends (not illustrated) to the palletized load 295 in a known manner. The rotatable platform 213 then may be rotated (using, for example, a known type of motor and shaft arrangement not shown in FIG. 6), thereby pulling stretch film through the guides and extending first and second ropes 280 and 281 to wrap the palletized goods 295 as already described. It may be well to point out that although the stretch wrap machine 270 includes a rotating platform 213, portions of the stretch wrap machine 270 that form the stretch ropes 280 and 281 (i.e. the palletized load-securing apparatus) are fixed relative to the palletized load 295 being secured and relative to the rotatable platform 213.

Figure 7:
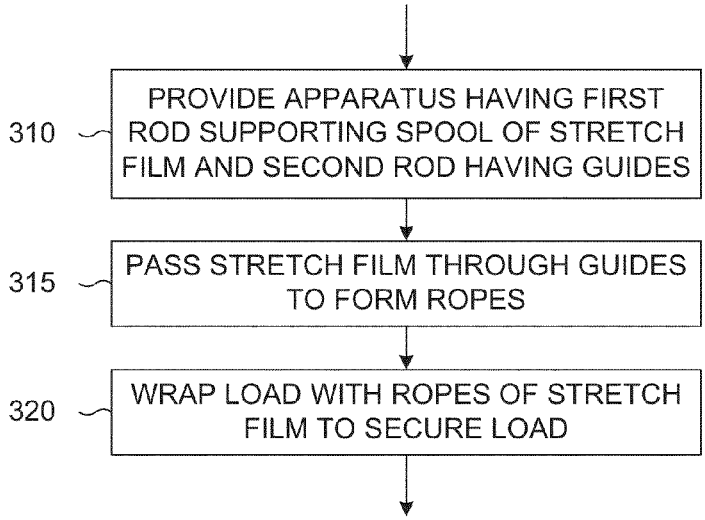
FIG. 7 is a flow diagram describing a particular implementation of a method of securing a palletized load.

FIG. 7 is a flow diagram describing a particular implementation of a method of securing a palletized load. According to this implementation of the method, an apparatus is provided, the apparatus having a first rod that supports a single spool supporting a plurality of rolls of stretch film and a second rod that supports a plurality of guides (step 310). The plurality of rolls of stretch film may be disposed on the single spool in essentially adjacent positions, i.e., substantially contiguously. As a particular example, the apparatus described supra with reference to FIG. 6 may be provided, wherein the apparatus comprises a spool support member 206, which may be a rod, supporting the spool 202 on which are wound first and second rolls of stretch film 215 and 216 disposed substantially contiguously. The second rod of the implementation of FIG. 7 may be implemented as, for example, the guide support member 261 illustrated in FIG. 6, the guide support member 261 being rigidly supported by the platform 205 and the bracket 210, and having pairs of guides 220 adjustably secured thereto by the plurality of collars 230.

The implementation of the method of FIG. 7 further comprises passing stretch film from the plurality of rolls through the plurality of guides to form a plurality of ropes of stretch film (step 315). As a specific example, FIG. 6 illustrates stretch film from first roll 215 and second roll 216 passing through guides formed by pairs of rollers 220 to form first rope 280 and second rope 281 of stretch film. As another example, FIG. 1 illustrates stretch film from first roll 15 and second roll 16 passing through ring-shaped first and second guides 30 and 31 to form first and second ropes of stretch film 50 and 51.

The implementation of the method illustrated in FIG. 7 still further comprises securing the palletized load by wrapping the palletized load with the plurality of ropes formed in step 315, thereby securing the palletized load (step 320). It should be noted that no cutting of stretch film is employed in the illustrated implementation of the method. Exemplary implementations of this securing step (i.e., step 320) are illustrated in FIGS. 2 and 5A. In FIG. 2, a user may transport a palletized load-wrapping apparatus around a palletized load, thereby securing the palletized load with first and second ropes 50 and 51 of stretch film. The first and second ropes 50 and 51 are formed by passing the stretch film through first and second guides 30 and 31. In FIG. 6, a stretch machine 270, operating as described herein, secures a palletized load 295 by wrapping first and second ropes 280 and 281 around the palletized load 295 as the palletized load 295 rotates. First and second ropes are formed by passing stretch film through guides formed by pairs of rollers 220. Neither the implementation of FIG. 2 nor the implementation of FIG. 6 includes a mechanism for cutting stretch film, nor does the implementation of FIG. 7 contemplate any cutting of stretch film.

Figure 8:
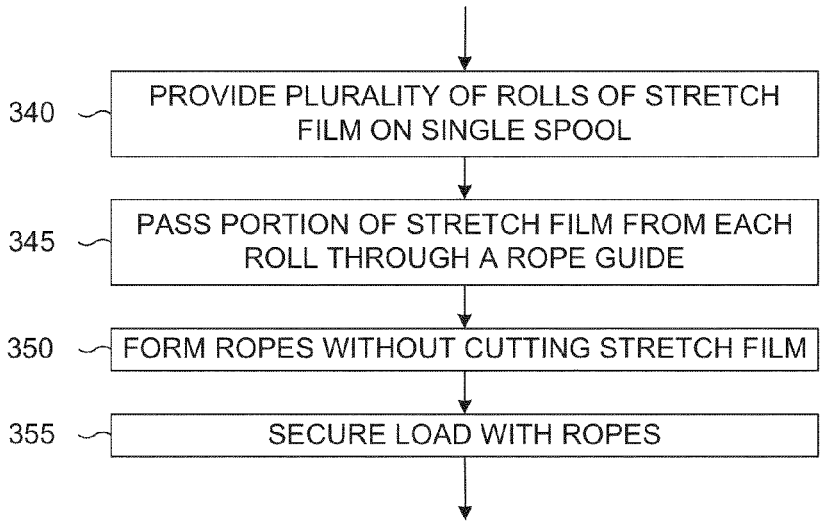
FIG. 8 is a flow diagram describing a particular implementation of a method of protecting a palletized load.

FIG. 8 is a flow diagram describing another particular implementation of a method of protecting a palletized load. According to the illustrated implementation, a plurality of rolls of stretch film (e.g., two or more rolls) is provided on a single spool (step 340). In a typical implementation, the single spool has an axis. A particular implementation that provides a plurality of rolls of stretch film is illustrated in FIG. 1, wherein is illustrated first and second rolls 15 and 16 of stretch film provided essentially contiguously positioned on a single spool 2. Another particular implementation that provides such a plurality of rolls of stretch film is shown in FIG. 6, which shows first and second rolls 215 and 216 on single spool 202.

The implementation of FIG. 7 further comprises passing a portion of stretch film from each roll through a rope guide (step 345). For example, stretch film from each of the first and second rolls 15 and 16 of stretch film may be passed through respective first and second guides 30 and 31 (functioning as rope guides) in the particular implementation shown in FIG. 1. As another example, FIG. 6 illustrates stretch film from each of first and second rolls 215 and 216 of stretch film passed through guides formed by pairs of rollers 220, the guides functioning as rope guides.

The implementation of FIG. 8 still further comprises forming a plurality of ropes without cutting the stretch film (step 350). One particular implementation of a method of forming the plurality of ropes is illustrated in the flow diagram of FIG. 9, described infra.

The implementation of FIG. 8 yet still further comprises securing the palletized load with the plurality of ropes (step 355). The securing may be accomplished using particular implementations already described. For example, FIG. 2 illustrates a pair of users cooperating to secure a palletized load. A first user (i.e. one having first arm 80 and second hand 81) moves around a palletized load while supporting an apparatus 10 adapted to form first and second ropes 50 and 51 of stretch film. A second user having hand 82, grasps initial ends of the first and second ropes 50 and 51. As the first user moves around the palletized load, the first and second ropes 50 and 51 become extended, wrapping, and thereby securing, the palletized load. As another example, a palletized load 295 may be secured as illustrated in FIG. 6 by first and second ropes 280 and 281 of stretch film formed by a stretch wrap machine 270 operating as described herein. As the palletized load 295 rotates on the rotatable platform 213, first and second ropes are extended and wrapped around the palletized load 295 to secure the palletized load 295.

Figure 9:
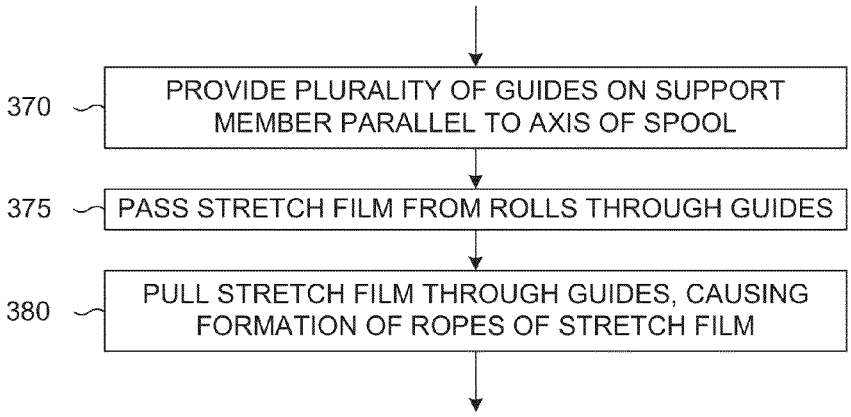
FIG. 9 is a flow diagram depicting a particular implementation of a method of forming a plurality of ropes according to the flow diagram of FIG. 8.

FIG. 9 is a flow diagram depicting a particular implementation of a method of forming a plurality of ropes according to the flow diagram of FIG. 8. The illustrated implementation comprises providing a plurality of guides (step 370) adjustably secured to a support member disposed parallel to the axis of the spool referenced in step 340 of FIG. 8. For example, the providing of guides may be accomplished as illustrated in FIG. 2, wherein first and second guides 30 and 31 are adjustably secured to guide support member 20 by first and second collars 35 and 36. Guide support member 20 is secured in a position having its axis oriented in a direction parallel to an axis of the spool 2 by baseplate 40. In FIG. 6, a pair of guides is provided, each guide formed by a pair of rollers 220 adjustably secured to a guide support member 261 by collars 230, wherein the axis of the guide support member 261 is nominally parallel to the axis of the spool 202 as already described. The particular implementation of FIG. 9 further comprises passing stretch film from the plurality of rolls through the plurality of guides (step 375). See, for example, FIG. 1, wherein stretch film from first roll 15 and second roll 16 is passed through, respectively, first guide 30 and second guide 31. Similarly, in FIG. 6, stretch film from first roll 215 passes through a guide formed by a pair of rollers 220, and stretch film form second roll 216 passes through another guide formed by another pair of rollers 220.

The particular implementation of FIG. 9 still further comprises pulling stretch film through the plurality of guides in order to cause formation of the plurality of ropes of stretch film (step 380). This step may be accomplished as illustrated in FIG. 1 wherein, for example, first rope 50 is bunched up as stretch film from first roll 15 passes through the first guide 30, thereby forming the first rope 50. Additional ropes may be similarly formed. In FIG. 5, first rope 180 is formed when stretch film from a first roll is guided by a pair of rollers 120.

It should be emphasized that positions of guides in the particular implementations of methods described in FIGS. 6-8 are adjustable as described with reference to, for example, FIG. 1 and FIG. 6. In a case of guides formed as rings (see, for example, FIG. 1), the rings may be adjusted either in a ganged arrangement or independently. Likewise, the guides formed by rollers 220 (FIG. 6) may be three-way adjustable: 1) Pairs of rollers may be moved in a ganged fashion; 2) pairs of rollers may be moved independently; and 3) rollers forming a pair may be moved farther apart or closer together in order to change a characteristic of ropes of stretch film according to preferences of a user.

Figure 10A:
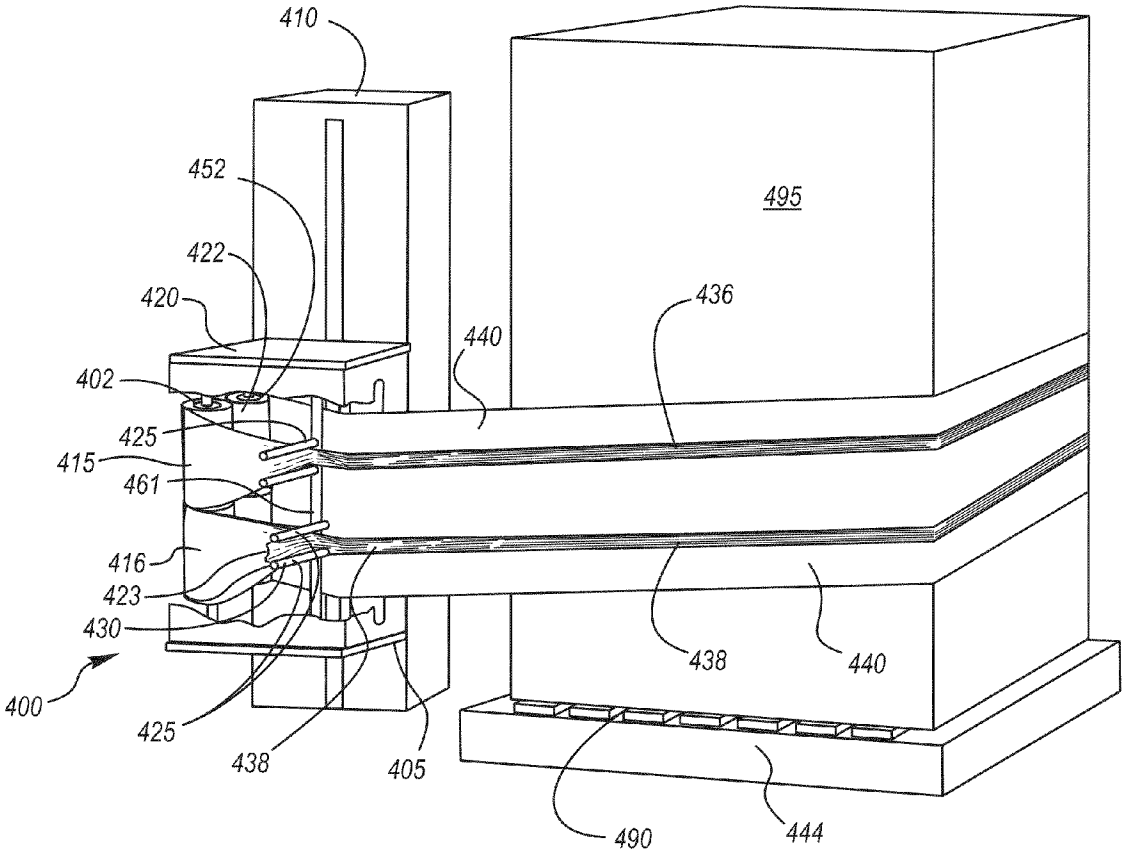
FIGS. 10*a* and 10*b* are, respectively, two embodiments of a stretch wrap machine using a pre-stretch carriage.

FIG. 10*a* is a pictorial diagram of a stretch wrap machine 400 that may include elements described with reference to FIG. 6. The illustrated implementation comprises carriage 405, moveably coupled to a carriage support 410. During operation of the stretch wrap machine 400, the carriage 405 is mechanically moved up and down the support 410 through a combination of gears and drives. A comparable carriage support and carriage system currently on the market is the SMH-200 Stretch Wrapper, sold by Wulftec International of QC, Canada. Those of ordinary skill in the art readily understand the use and operation of a conventional stretch wrapping machine of this type. FIG. 10*a* includes on the carriage 405 a conventional pre-stretch carriage 420 configured to stretch the stretch film passed through it prior to applying the stretch film to a pallet of goods to be wrapped, and at least one roll of stretch film 422 on a first spool 452. Stretch film from spool 452 may be referred to as a web 440. Different from a conventional stretch wrapping machine, however, the implementation of FIG. 10*a* includes at least a second roll of stretch film 415 or 416 supported on the carriage by a second spool 402. For this particular implementation, the stretch film web 440 from the first roll of stretch film 422 is simultaneously fed through the pre-stretch carriage 420 with the stretch film 436 and 438 from the at least a second roll of stretch film 415 or 416 after it has passed through guides 420. Typically, first and second rolls 415 and 416 are disposed next to each other on the second spool 402. The first and second rolls 415 and 416 may be disposed directly on the spool or disposed on separate spools that are then disposed on a common spool or roller (e.g. a common core with two spools around it and coupled to it) with the purpose that the first and second rolls necessarily unroll at substantially the same rate. If the first and second rolls 415 and 416 do not spin at substantially the same rate, as is necessitated by being on the same spool 402 or being otherwise equivalently forced to spin at substantially the same rate, the operation is less effective. In an alternative embodiment, only a single roll 416 is mounted on the second spool 402 and the film from the two separate rolls simultaneously feed through the pre-stretch carriage.

A guide support 461, which is also supported by and coupled to the carriage 405 and at a second end by bracket 410, may be disposed nominally parallel to and at a convenient distance from the second spool 402. That is, guide support 461 may have an axis that is parallel to the axis of the spool 402. A plurality of rollers 425, which may be arranged in pairs to form guides, two of which are illustrated, for example, in FIG. 10*a*, are adjustably connected with the guide support member 461 by a plurality of collars 430. The plurality of rollers 425 is positioned such that stretch film from first and second rolls 415 and 416 pass through the guide. The collars 430 may be configured so that positions of the plurality of rollers 425 may be adjusted. The space between the guides 425 is the guide width 423. Alternatively, multiple guides extending from a common post may be coupled to the guide support member 461 to establish a guide width 423. The guide width 423 is less than the width of either the first and second roll 415 and 416, such that when stretch film is passes from first and second rolls 415 and 416 through roller guides 425, the width of each stretch film is narrowed to what is commonly referred to as a "rope" or alternatively referred to as a "band".

Figure 10B:
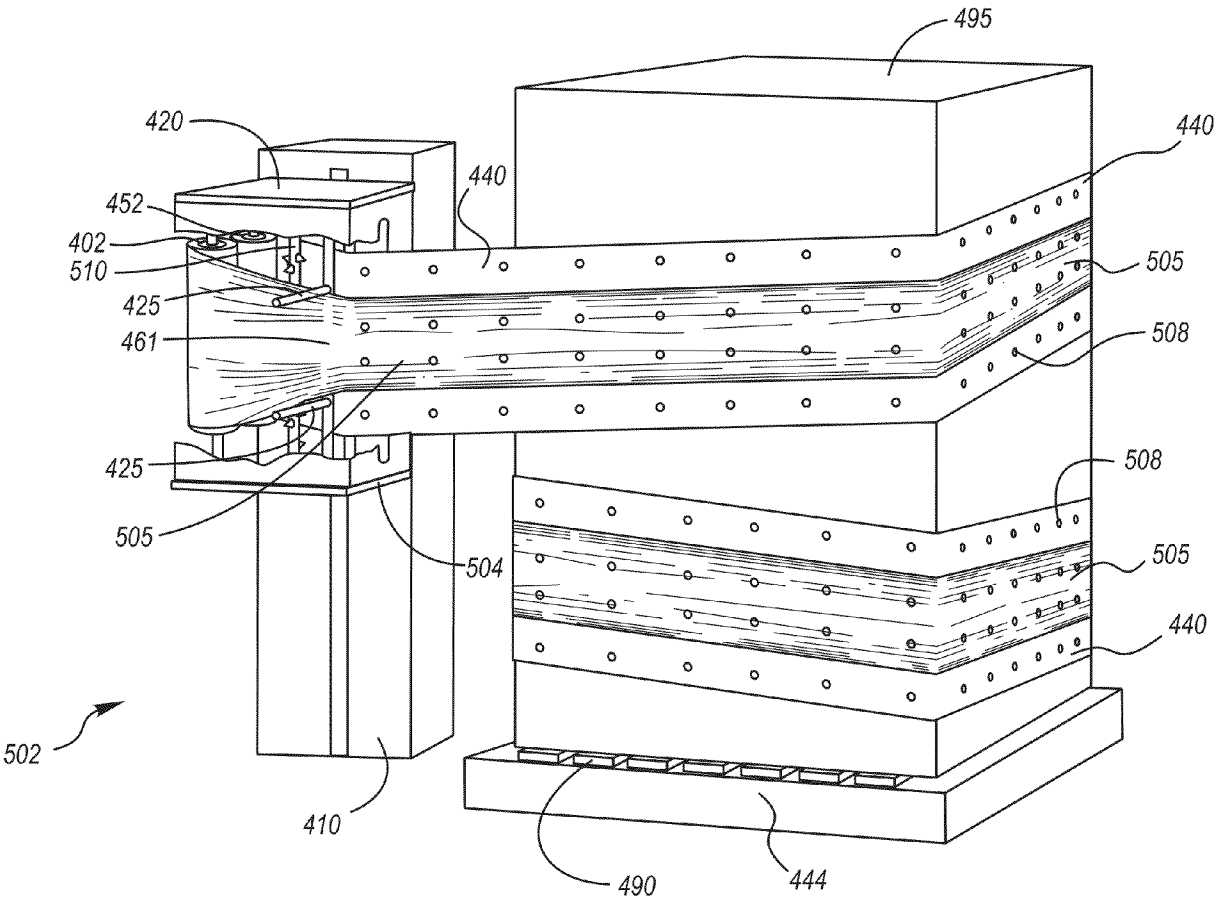

As stretch film from the first and second rolls 415 and 416 passes through a pair of guides (formed by pairs of rollers 425 in the implementation shown in FIGS. 10*a* and 10*b*), first and second ropes 436 and 438 of stretch film are formed. This disclosure, further, contemplates using one roll or two or more rolls. A plurality of rolls of stretch film in order to form a plurality of ropes of stretch film by passing the stretch film through a plurality of guides could be more than two although only two rolls, guides and ropes are illustrated in FIG. 10*a*. FIG. 10*b* illustrates another particular implementation of a pallet wrapping system 502 with a carriage 504 moveably mounted to a support 410 as with the particular implementation of FIG. 10*a*, but this particular implementation includes a spool 402 with only a single roll of stretch film 505 wound around the spool 402 (rather than the two rolls 415 and 416 of FIG. 10*a*). The setup for FIG. 10*b* still includes the guides 425 and guide support 461, but only one set of guides 425 to form only one wide rope 505. As illustrated, the first spool 452 feeds a web of stretch wrap 440 over a perforating spindle 510 having a plurality of pins/needles/spikes extending from it to perforate the web of stretch wrap 440 feeding across it before it enters the pre-stretch carriage 420.

Although, for purposes of clear illustration FIGS. 10*a* and 10*b* are shown to simultaneously dispose the web 440 and the ropes 436 and 438 or 505 on the palletized load with the web 440 closest to the load, this is not required and in some cases not preferred. In alternate implementations of any of the various embodiments described throughout this disclosure may be accomplished by simply reversing the positions of the rolls, or by wrapping the palletized load the other direction. In such implementations, the ropes 436 and 438 or 505 will be simultaneously disposed on the palletized load with the web 440 with the ropes 436 and 438 or 505 closest to the palletized load. In particular applications it may be desirable and advantageous to have the web 440 closest to the load while wrapping and in other applications it may be desirable and advantageous to have the web 440 covering the ropes 436 and 438 or 505 depending upon the type of load being wrapped and whether the web 440 and/or ropes 436 and 438 or 505 are perforated.

In particular implementations, such as that shown in FIG. 10*b*, the stretch film rope 505 from the second spool 402 may be fed across the perforating spindle 510 with the web of stretch wrap 440 to perforate it as well. As the stretch wrap 440 is stretched in the pre-stretch carriage 420 and applied to the pallet load 495, the perforated holes 508 are stretched much larger than their initial diameter forming a netting to allow air flow to the product being wrapped. It is contemplated that embodiments like that illustrated in FIG. 10*b* where the stretch wrap rope 505 does not become perforated, the rope maintains its full strength, but that other embodiments may perforate the rope/band as well or that in other particular implementations a separate perforating spindle with fewer pins/needles/spikes may be used for the rope to provide some air flow but not weaken the rope too much.

Figure 11A:
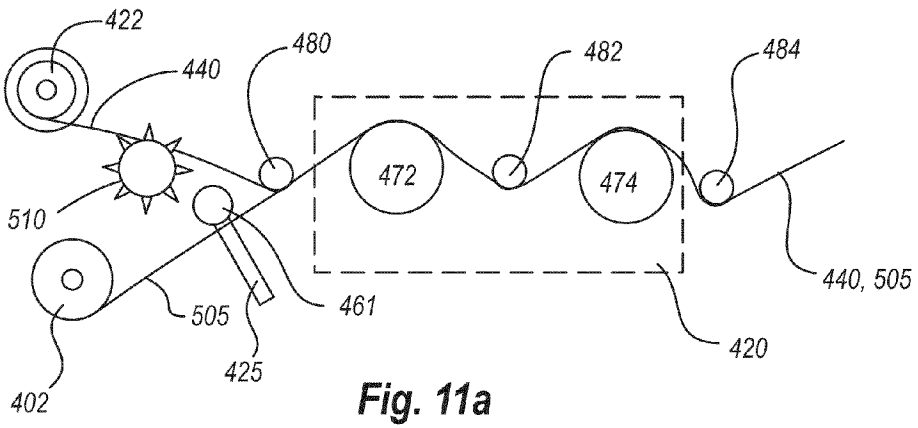
FIGS. 11*a* and 11*b* are, respectively, representative top and side views of the path of stretch film travel from the rolls of stretch film through one particular embodiment of a pre-stretch carriage.
Figure 11B:
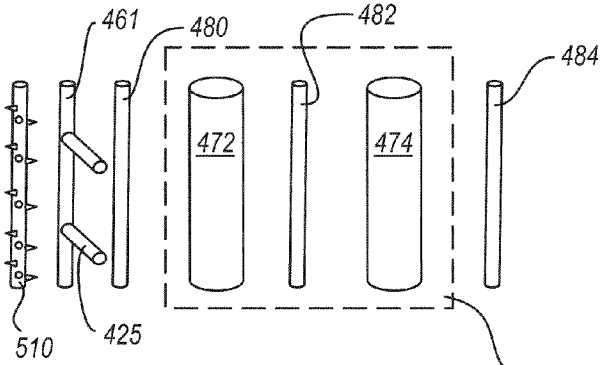

A pre-stretch carriage 420 may comprise any combination of rollers and components to pre-stretch the film being passed through it prior to applying the film to the pallet load 495 being wrapped. In the particular implementation illustrated by the rollers in FIGS. 11*a* and 11*b*, the pre-stretch carriage 420 comprises pre-stretch rollers 472 and 474 and idle roller 482. FIG. 11*a* represents the path of the various stretch films 440 and 505 as they pass from the spools 402, 452 through the pre-stretch carriage 420 on their way to the pallet load 495 FIG. 10*a*) to be wrapped. FIG. 11*b* represents the various components without the particular housing or the film shown for clarity. Adjacent to pre-stretch carriage 420 are idle rollers 480 and 484. It should be understood that idle rollers 480 and 484 may also be located within pre-stretch carriage 420 with no change in functionality and that other particular configurations may alternatively be used. Pre-stretch rollers 472 and 474 may be of different diameters, causing the stretch film to become stretched as it passes through pre-stretch carriage 420.

FIG. 11*a* shows a top view of pre-stretch carriage 420 to illustrate the path taken by one or more stretch wrap ropes 505 and stretch wrap web 440 as they simultaneously traverse through pre-stretch carriage 420. In this particular implementation, only one stretch wrap rope 505 is illustrated, though as with other embodiments shown and described herein, multiple stretch wrap ropes may be used. Stretch wrap web 440 passes over the perforating spindle 510, where it is perforated as described above. Thereafter, the combination of the one or more stretch wrap ropes 505 and the stretch wrap web 440 wind past idle roller 480, pre-stretch roller 472, idle roller 482, pre-stretch roller 474, and idle roller 484. Pre-stretch rollers 472 and 474 may be of different diameters. Thus, as the one or more stretch wrap ropes 505 and the stretch wrap web 440 pass through the rollers, the different diameters of pre-stretch rollers 472 and 474 cause the ropes 505 and web 440 to stretch simultaneously. It should be understood that other configurations of pre-stretch carriage 420 may be used in conjunction with stretch wrap machines 400, 502.

The stretch wrap system 400, 502 may comprise a common support (not shown) for the carriage support 410 and a rotatable platform 444 on which may be placed a pallet 490 with a load 495 of palletized goods. The arrangement of the load 495 is not critical to this disclosure and has been shown as a non-descript cube for simplicity.

In operation, and with reference to the respective portions of both FIGS. 10*a* and 10*b*, the pallet 490 and the palletized load 495 may arrive at the stretch wrap machine 400, 502 and may be placed onto the rotatable platform 444. One or more stretch wrap ropes 436, 438 and 505 may be formed as described herein in addition to the stretch wrap web. As illustrated in FIG. 11*a*, a portion of the path of the stretch wrap ropes 436, 438 and 505 from the second spool 402 to the palletized load 495 overlaps with a portion of the path of stretch wrap web 440 from the first spool 452 to the palletized load 495 after the one or more stretch wrap ropes 436, 438 and 505 pass through guides 425 so that the one or more ropes and the stretch wrap web 440 are applied to the palletized load 495 simultaneously. In one embodiment, a pre-stretch carriage 420 is along the overlapping path such that the paths overlap through pre-stretch carriage 420. Then the ropes and web 440 combination are attached at initial ends (not illustrated) to the palletized load 495 in a known manner. The rotatable platform 444 then may be rotated (using, for example, a known type of motor and shaft arrangement as is conventional with this type of stretch wrapping system), thereby pulling stretch film through the guides and extending the at least one rope 436, 438 and 505 and the stretch wrap web 440 to wrap the palletized goods 495 as already described. The carriage 420 is moved up and down on the carriage support 410 as the pallet turns to wrap the pallet, overlapping combinations of previously simultaneously applied rope and web layers. It should be understood that the use of pre-stretch carriage 420 is optional as is the perforating spindle 510. The combination of one or more ropes 436, 438 and 505 with stretch wrap web 440 may be performed without pre-stretching.

It will be understood that implementations are not limited to the specific components disclosed herein, as virtually any components consistent with the intended operation of a method and/or system implementation for securing palletized loads may be utilized. Accordingly, for example, although particular components may be disclosed, such components may comprise any shape, size, style, type, model, version, class, grade, gauge, measurement, concentration, material, weight, quantity, and/or the like consistent with the intended operation of a method and/or system implementation for a palletized load wrapping machine may be used. By specific example, another method and apparatus for wrapping a palletized load known in the art involves a palletized load remaining stationary and the wrapping carriage moving up and down and around the palletized load. It is specifically contemplated that the wrapping carriages of these methods and apparatus would be readily modified by those of ordinary skill in the art to include the advantages of the wrapping carriages and machines identified in this disclosure. Accordingly, it is considered within the scope of this disclosure to include such methods and apparatus adapted to include the carriages and methods described within this disclosure relating to rotating palletized loads.

In places where the description above refers to particular implementations of palletized load-wrapping apparatus, it should be readily apparent that a number of modifications may be made without departing from the spirit thereof and that these implementations may be applied to other forms of devices that secure palletized loads. In particular, the above description describes hand-held and stationary versions of palletized load-wrapping machines. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

It is claimed:

1. An apparatus for securing a palletized load, the apparatus comprising:

a first roll of stretch film supported by a first spool support member;

at least two second rolls of stretch film positionally coupled to a common spool core such that the at least two second rolls of stretch film unroll at substantially the same rate, the common spool core being supported by a second spool support member;

at least two sets of guides positioned adjacent to the second spool support member, each set of guides having a guide width less than a width of each of the at least two second rolls, each of the at least two second rolls of stretch film positioned to pass through a different set of the at least two sets of guides;

wherein two portions of a first path of the stretch film from the first roll of stretch film to a load to be secured are overlapped by two second paths of the stretch film from the at least two second rolls of stretch film to the load to be secured after the stretch film from the at least two second rolls of stretch film pass through the at least two sets of guides such that the stretch film from the at least two second rolls of stretch film is applied to the load simultaneous with the stretch film from the first roll of stretch film.

2. The apparatus of claim 1, further comprising a pre-stretch carriage along the first path and the second paths between the first and second rolls of stretch film and the load; wherein the first path and the second paths overlap through the pre-stretch carriage.

3. The apparatus of claim 2, wherein the pre-stretch carriage is configured to simultaneously stretch the overlapping stretch film from the first roll of stretch film and stretch film from the at least two second rolls of stretch film prior to the stretch films being simultaneously applied to the load.

4. The apparatus of claim 1, further comprising a perforating spindle positioned to perforate the first path of stretch film without perforating the second paths of stretch film.

5. The apparatus of claim 1, wherein the two sets of guides comprises two sets of guide rollers.

6. A method of securing a palletized load comprising:

dispensing a first stretch film from a first roll of stretch film supported on a first support member;

dispensing at substantially the same rate at least two second stretch films from at least two second rolls of stretch film positionally coupled to a common spool core supported on a second support member;

narrowing a band width of each of the at least two second stretch films with two sets of guides;

overlapping two portions of the first stretch film with the two narrowed second stretch films; and simultaneously applying the overlapped first stretch film and second stretch film to a load to be secured after they have been overlapped.

7. The method of claim 6, further comprising simultaneously pre-stretching the dispensed first stretch film and second stretch films while overlapped prior to applying the first and second stretch films to the load.

8. The method of claim 7, wherein simultaneously pre-stretching the dispensed first and second stretch films while overlapped comprises simultaneously pre-stretching the dispensed first and second stretch films while overlapped with two pre-stretch rollers and an idle roller positioned between the two pre-stretch rollers in a pre-stretch carriage.

9. The method of claim 8, wherein simultaneously pre-stretching the first and second stretch films further comprises simultaneously pre-stretching the dispensed first stretch film and at least two bands of the second stretched film while overlapped prior to applying the films to the load.

10. The method of claim 6, wherein simultaneously applying the overlapped first and second stretch films comprises circumnavigating the palletized load with the overlapped first and second stretch films resulting in multiple layers of overlapped first and second stretch films overlapped upon each other.

11. The method of claim 6, wherein applying the overlapped first and second stretch films results in the first stretch film being closer to the load than the second stretch film.

12. The method of claim 6, wherein applying the overlapped first and second stretch films results in the second stretch film being closer to the load than the first stretch film.

13. The method of claim 6 further comprising perforating the first film without perforating the second stretch films prior to said applying step.

14. The method of claim 6, further comprising perforating both the first and second stretch films prior to said applying step.

15. An apparatus for securing a palletized load, the apparatus comprising:

a first roll of stretch film supported by a first spool support member;

a plurality of separate rolls of stretch film on a common spool core, the spool core being positionally coupled to each of the plurality of rolls such that the rolls unroll at substantially the same rate, the spool core being supported by a second spool support member;

wherein the first roll, plurality of separate rolls and a pre-stretch carriage are mutually positioned such that the pre-stretch carriage simultaneously receives first stretch film from the first roll and second stretch film from the plurality of separate rolls in an overlapped manner and simultaneously pre-stretches the first and second stretch films prior to simultaneously applying the overlapped first and second stretch films to a load.

16. The apparatus of claim 15, further comprising a plurality of sets of guides positioned adjacent to the common spool core, each set of guides having a guide width less than a width of each of the plurality of separate rolls of stretch film on the common spool core and each of the plurality of separate rolls of stretch film positioned to pass through the respect guide such that the stretch film from each of the plurality of separate rolls of stretch film overlaps a different portion of the stretch film of the first roll of stretch film after the plurality of separate rolls of stretch film pass through the plurality of sets of guides to form a plurality of bands of stretch film.

17. The apparatus of claim 16, further comprising a pre-stretch carriage comprising at least one pre-stretch roller and at least one idle roller and positioned to simultaneously stretch the overlapping stretch film from the first roll of stretch film and the plurality of bands of stretch film from the plurality of separate rolls of stretch film prior to the stretch films of the first roll and plurality of separate rolls being simultaneously applied to the load.

* * * * *